US005801727A

United States Patent [19]

Torpey

[11] Patent Number: 5,801,727

[45] Date of Patent: Sep. 1, 1998

[54] APPARATUS AND METHOD FOR PRINTING DEVICE

[75] Inventor: Peter A. Torpey, Webster, N.Y.

[73] Assignee: Xerox Corporation, Stamford, Conn.

[21] Appl. No.: 740,743

[22] Filed: Nov. 4, 1996

[51] Int. Cl.[6] ..... B41J 2/145; B41J 2/15; B41J 2/05

[52] U.S. Cl. ..... 347/40; 347/57

[58] Field of Search ..... 347/40, 10, 13, 347/37, 57; 349/9, 5

[56] References Cited

U.S. PATENT DOCUMENTS

| | | | |
|---|---|---|---|
| 4,032,929 | 6/1977 | Fischbeck et al. . | |
| 4,115,789 | 9/1978 | Fischbeck et al. | 347/42 |
| 4,463,359 | 7/1984 | Ayata | 347/56 |
| 4,571,599 | 2/1986 | Rezanka | 347/87 |
| 4,638,377 | 1/1987 | Dakin | 386/104 |
| 4,774,530 | 9/1988 | Hawkins | 347/63 |
| 4,803,499 | 2/1989 | Hayamizu | 347/63 |
| 4,829,324 | 5/1989 | Drake et al. | 347/63 |
| 4,851,371 | 7/1989 | Fisher et al. | 347/42 |
| 4,899,181 | 2/1990 | Hawkins et al. | 347/63 |
| 4,985,710 | 1/1991 | Drake et al. | 347/63 |
| 5,160,945 | 11/1992 | Drake . | |
| 5,257,043 | 10/1993 | Kneezel . | |
| 5,432,539 | 7/1995 | Anderson . | |
| 5,457,483 | 10/1995 | Oikawa | 347/129 |
| 5,512,924 | 4/1996 | Takada et al. | 347/18 |
| 5,608,431 | 3/1997 | Kishida et al. | 347/13 |

*Primary Examiner*—N. Le
*Assistant Examiner*—Thinh Nguyen
*Attorney, Agent, or Firm*—Fay, Sharpe, Beall, Fagan, Minnich & McKee

[57] ABSTRACT

A wide array ink jet printhead for use in an ink jet printing device and being capable of propelling ink to create a line on a recording medium in the device. The printhead includes a plurality of adjacent and generally linear printheads each having a first and second end ink jet. A plurality of electrodes are in communication with the ink jets. A microprocessor controls the electrodes to selectively provide a current signal representing digitalized data to the electrodes. When the digitalized signal is intended to create a line on the recording medium more than one printhead wide, the ink jets on adjacent printheads forming the line are initialized from a first end ink jet to a second end ink jet on a first printhead and in a reverse order from a second end ink jet to a first end ink jet on the adjacent printhead, the sequences commencing substantially simultaneously on each printhead.

15 Claims, 5 Drawing Sheets

FIG. 1
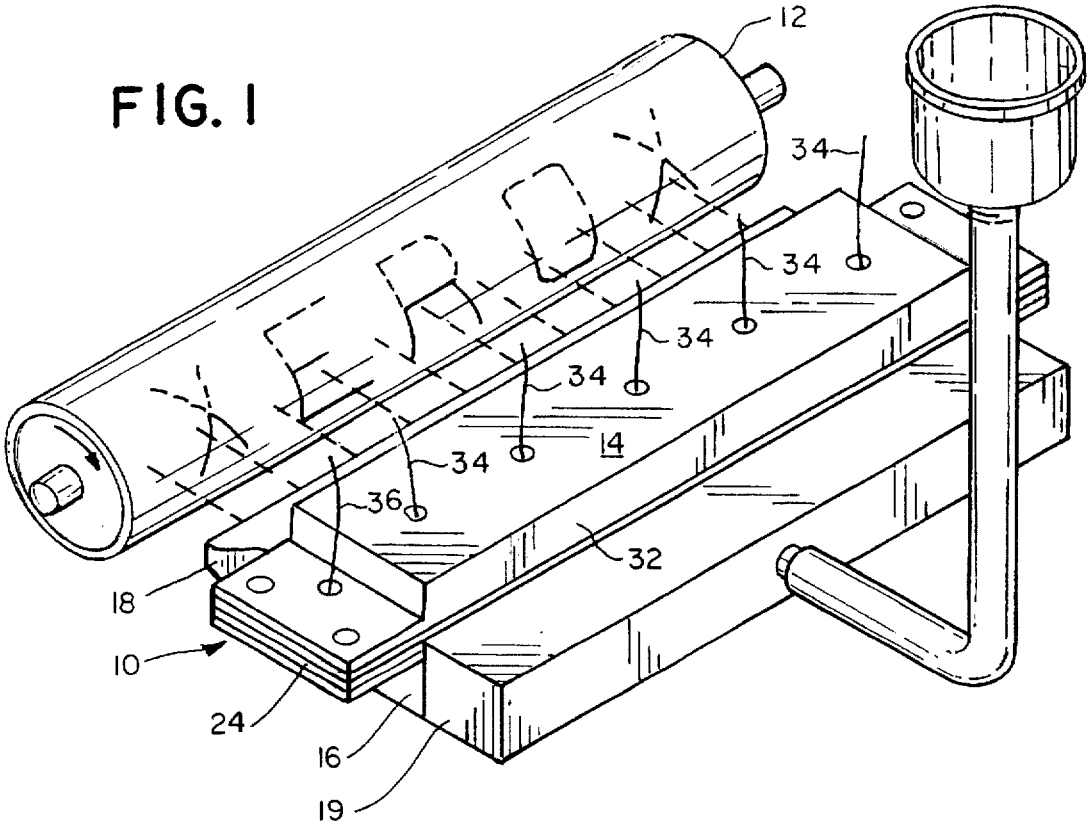
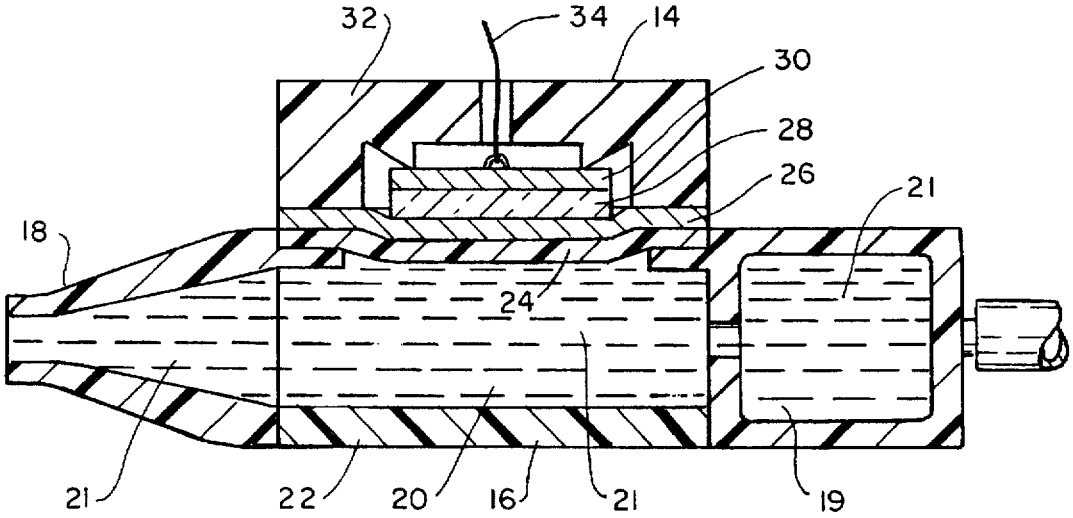
FIG. 2

| |
|---|
| 14:05:41 |
| 14:09:58 |
| 14:15:36 |
| 14:22:45 |
| 14:28:55 |
| 14:35:08 |
| 14:39:45 |
| 14:55:48 |
| 15:01:16 |
| 15:06:16 |
| 15:30:57 |

FIG. 6A

| |
|---|
| 14:05:41 |
| 14:09:58 |
| 14:15:36 |
| 14:22:45 |
| 14:28:55 |
| 14:35:08 |
| 14:39:45 |
| 14:55:48 |
| 15:01:16 |
| 15:06:16 |
| 15:30:57 |

FIG. 6B

APPARATUS AND METHOD FOR PRINTING DEVICE

BACKGROUND OF THE INVENTION

This invention relates to a printing apparatus. More particularly, this invention relates to a printing apparatus of the type having a linear array of multiple printheads.

The printhead array of the present invention is particularly well suited to be used with ink jet printheads in a drop-on-demand style of printer. In drop-on-demand ink jet printing systems, a droplet is expelled from a nozzle directly to a recording medium along a generally straight line that is substantially perpendicular to the recording medium. The droplet expulsion is in response to digital information signals. There are two basic propulsion techniques for the drop-on-demand ink jet printers. One uses a piezoelectric transducer to produce pressure pulses selectively to expel the drops and the other technique uses thermal energy, usually via the momentary heating of a resistor, to produce a vapor bubble in the ink, which during its growth expels a droplet. Either technique uses ink-filled channels or passageways which interconnect an orifice or nozzle and an ink-filled manifold.

Referring more particularly to thermal ink jet printers, printing signals representing binary digital information originate an electric current pulse of a predetermined time duration in a small resistor within each ink channel near the nozzle, causing the ink in the immediate vicinity to evaporate almost instantaneously and create a vapor bubble. The ink at the orifice is forced out as a propelled droplet by the bubble. At the termination of the current pulse, the bubble collapses and the process is ready to start all over again as soon as hydrodynamic motion or turbulence of the ink stops. The turbulence in the channel generally subsides in fractions of milliseconds so that thermally expelled droplets may be generated in the kilohertz range. Small resistors in the channels near the nozzles are individually addressable by current pulses representative of digitized information or video signals, so that each droplet expelled and propelled to the recording medium prints a picture element or pixel.

Throughout the specification, numerous references will be made to the use of the present inventive linear ink jet array in full page width printers having a moving recording medium. However, it should be realized that the invention could also be used in a variety of printers in which adjacent printheads are used to print on a stationary recording medium. For example, the present invention has particular utility in a partial width array on a reciprocating carriage.

More specifically, the present invention is suited to the printing systems and incorporates the methods of manufacturing printing systems and the manners of operating printing systems which are described in U.S. Pat. Nos. 4,032,929; 4,115,789; 4,463,359; 4,571,599; 4,638,377; 4,774,530; 4,803,499; 4,829,324; 4,851,371; 4,899,181; 4,985,710; 5,160,945; 5,257,043; and 5,432,539. Accordingly, each of these patents is herein incorporated by reference.

Currently, full width array printhead bars are made by butting together a plurality of printheads, each printhead including multiple ink jets. For example, U.S. Pat. No. 4,032,929 discloses a linear array of piezoelectric ink jets. Similarly, U.S. Pat. No. 5,160,945, displays a linear array of thermal ink jets. In each of these representations, the printing apparatus moves a recording medium adjacent to the fixed array printhead to allow printing.

In general, a printing operation with the above described printheads involves firing the jets sequentially (in blocks) from a jet at a first end of each individual printhead to a jet at the second end of each printhead. Accordingly, in a horizontal printhead array, the first jet on the left of each printhead will fire first followed simultaneously by the remaining jets to the right. However, each printhead in the array begins the sequential firing pattern simultaneously. In general, an ink jet array must be fired sequentially because simultaneous firing would require too great of an electrical requirement, more specifically, the current draw would be too great.

When the printhead array bar is positioned normal to the direction of recording medium motion, a "saw tooth" pattern occurs when trying to print a straight, horizontal line. More specifically, the teeth in the saw tooth pattern occur where the first-to-fire jet of a first printhead is adjacent to the last-to-fire jet of a neighboring printhead. The magnitude of the "saw tooth" pattern is dependent on the time between firing the first jet and the last jet, and the velocity at which the paper is moving under the printhead array.

In certain commercially available printers, the "saw tooth" pattern print defect is avoided by tilting the printhead array bar to compensate for the lines of the saw tooth pattern. Moreover, the print bar is tilted by one scan line per printhead. However, such tilting requires that each printhead be printing information from a different scan line of the input image. This microprocessing step requires a significant amount of memory and processing power, necessitating expensive equipment to operate.

Accordingly, it would be desirable to provide a lower cost mechanism for reducing the visual impact of the "saw tooth" pattern.

SUMMARY OF THE INVENTION

Accordingly, it is a primary object of this invention to provide a new and improved linear array printhead system. It is an advantage of this invention to provide a linear array printhead system which requires only basic microprocessing capabilities.

To achieve the foregoing objects in accordance with the purpose of the invention as embodied and broadly described herein, an ink jet printhead system for use in a printing device comprises a plurality of adjacent and generally linear printheads including a plurality of generally linear ink jets having a first end ink jet and a second end ink jet. A plurality of firing electrodes are in communication with the ink jets and are controlled by a microprocessor. The microprocessor selectively provides a current representing digitalized data signals to each electrode. When the digitalized data signal is to create a line on the recording medium which is more than one printhead in width, the initializing signals to the electrodes are provided generally sequentially from a first ink jet on a first end of the printhead to an ink jet at the second end of the printhead and on the adjacent printhead in the opposed direction from the ink jet at the second end to an ink jet at the first end.

The present invention is also directed to a method of printing comprised of providing a printing surface moving adjacent an elongated printing member. The printing member is comprised of at least two generally linearly aligned printheads. Each printhead is comprised of a plurality of generally linearly aligned ink jets. A firing signal is selectively and sequentially provided to each of the ink jets. When a line having a width greater than one printhead is being printed on the recording medium, the firing sequence in adjacent printheads forming the line is performed in linearly opposed directions such that adjacent ink jets on adjacent printheads fire closest in time to one another.

The apparatus and method of the present invention are particularly suited to use with thermal and piezoelectric ink jets. The apparatus and method of the present invention are also believed to be particularly suited to use with full page width printing devices wherein the recording medium is moved adjacent the printing array by means of a mandrel or continuous belt.

It is a preferred feature of the present invention that a line printed having a width of greater than one printhead displays no divergence in adjacent pixels of greater than 20 to 80 microns, preferably no greater than 40 microns at a recording medium speed of five (5) inches per second.

BRIEF DESCRIPTION OF THE DRAWINGS

The invention consists in the novel parts, construction, arrangements, combinations and improvements shown and described. The accompanying drawings, which are incorporated in and constitute a part of the specification illustrate one embodiment of the invention and, together with the description, serve to explain the principles of the invention.

FIG. 1 is a perspective view of a piezoelectric printhead array suited to incorporation of the present invention;

FIG. 2 is a cross-sectional view of a piezoelectric printhead, generally of the configuration of FIG. 2;

FIGS. 6A and 6B are a full page reproduction demonstrating the efficiency of the present invention (FIG. 6; 4× magnification) as opposed to historic sequential ink jet firing (FIG. 6A; 4× magnification)

DETAILED DESCRIPTION OF THE INVENTION

Figure 3:
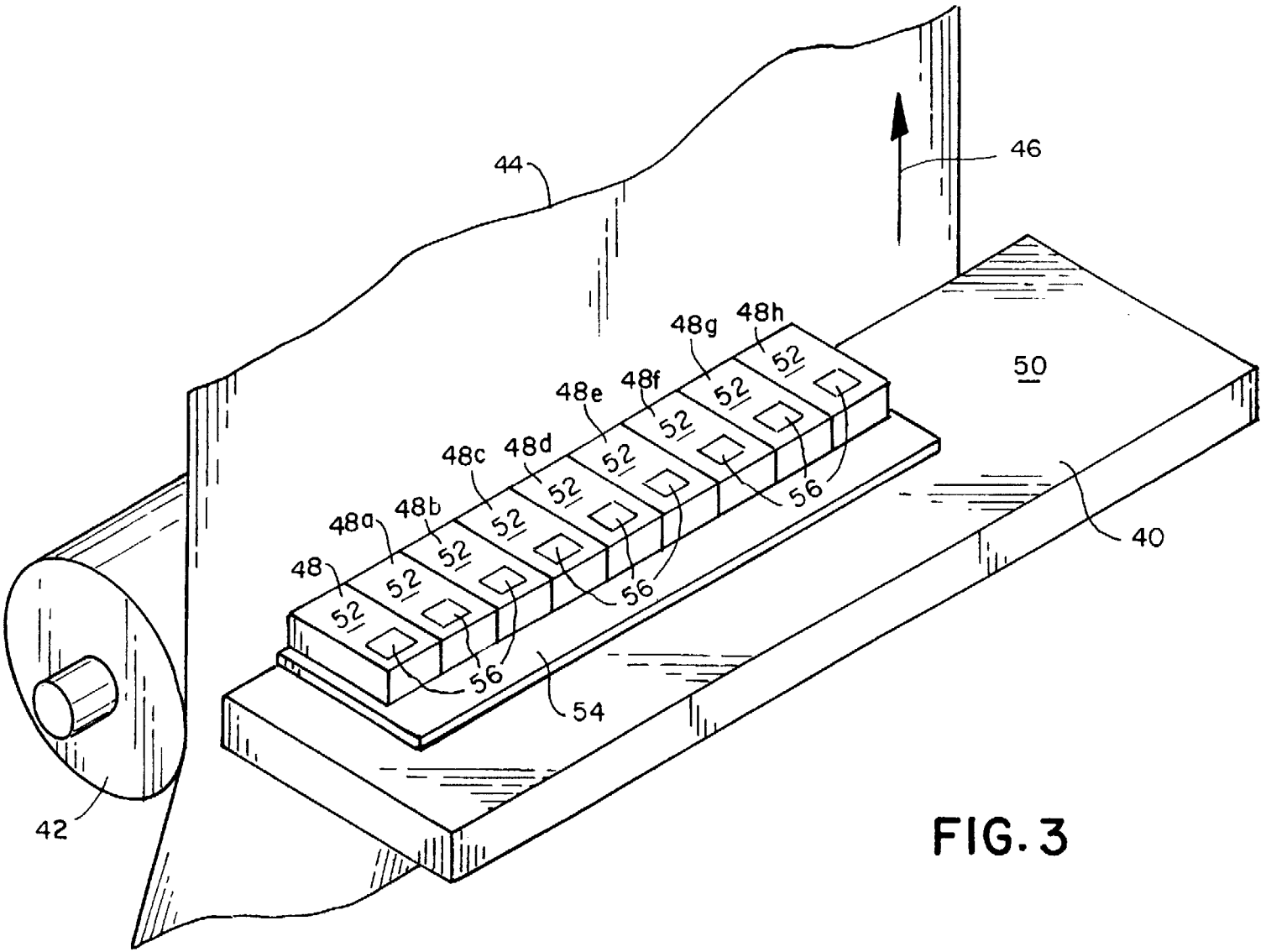
FIG. 3 is a perspective view of a thermal electric printhead array suited to incorporation of the present invention.

Referring first to FIGS. 1 and 2, a piezoelectric multiple ink jet assembly 10 is arranged opposite a rotating recording medium 12 for depositing ink droplets thereon. The assembly comprises a driver unit 14 releasably secured to an ink jet instrument unit 10. The instrument unit 10 is comprised of an elongated plastic or ceramic chamber unit 16, a plastic or ceramic multiple nozzle unit 18 attached to the front of the chamber unit 16, and a plastic or ceramic manifold reservoir unit 19, containing ink 21, attached to the rear of chamber unit 16. The chamber unit 16 is comprised of a plurality of rectangular shaped chambers 20 separated by side walls (not shown) projecting upward from a bottom wall 22. An elastic thin diaphragm 24 spans the upper edge of each side wall to form an upper wall of the chamber unit 16. The elastic diaphragm 24 is preferably formed of an elastic material, such as stainless steel, glass or nickel.

The driver unit 14 includes a plurality of transducer members comprising an electrically conductive elastic metal web 26 and a plurality of longitudinally spaced piezoelectric ceramic members 28 bonded to the web 26. A plurality of electrodes 30 are bonded to the piezoelectric members 28 and contained by a ceramic or plastic carrier bar 32.

Figure 7:
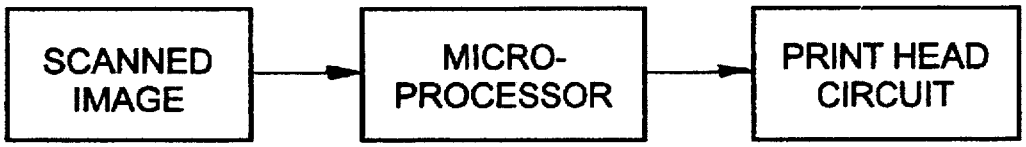
FIG. 7 is a schematic representation of a microprocessor in electric connection with ink jet firing circuitry.

A plurality of electric leads 34 (only a few of which are shown) are connected to electrodes 30 and an electrical lead 36 is connected to the web 26. The leads 34 and 36 are connected to a microprocessor control (not shown) so that the electrode 30 for each piezoelectric member may be separately addressed. Accordingly, each electrode 30 is separately activated by signals from a microprocessor (see the general arrangement of FIG. 7) which has processed a scanned image into a deliverable, digitalized signal that recreates a scanned image.

Figure 4:
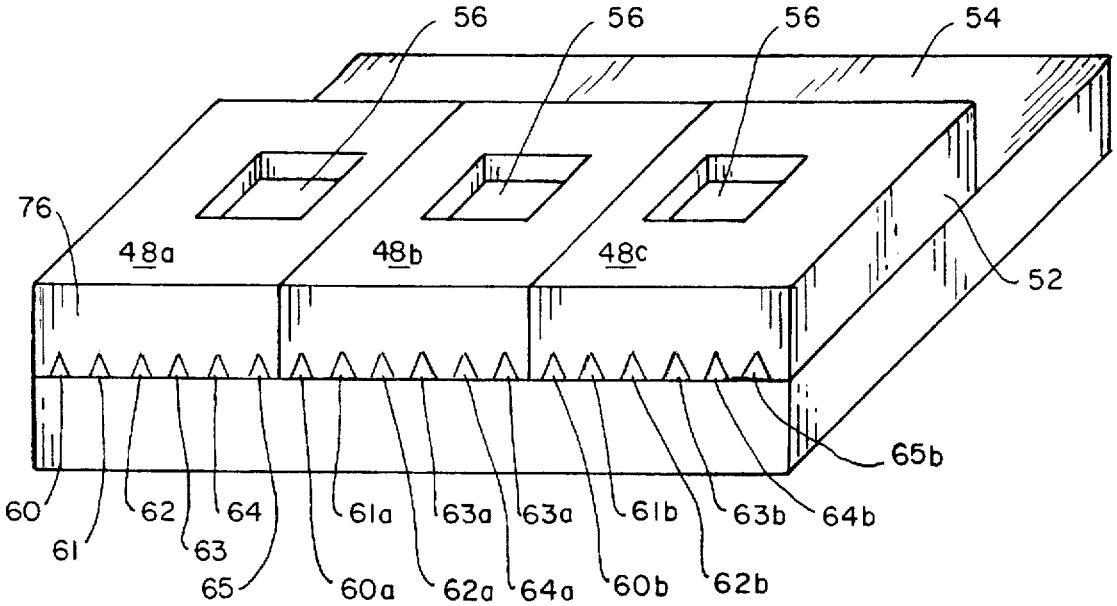
FIG. 4 is a front face perspective view of a section of a thermal ink jet printhead array, generally of the configuration of FIG. 3.
Figure 5:
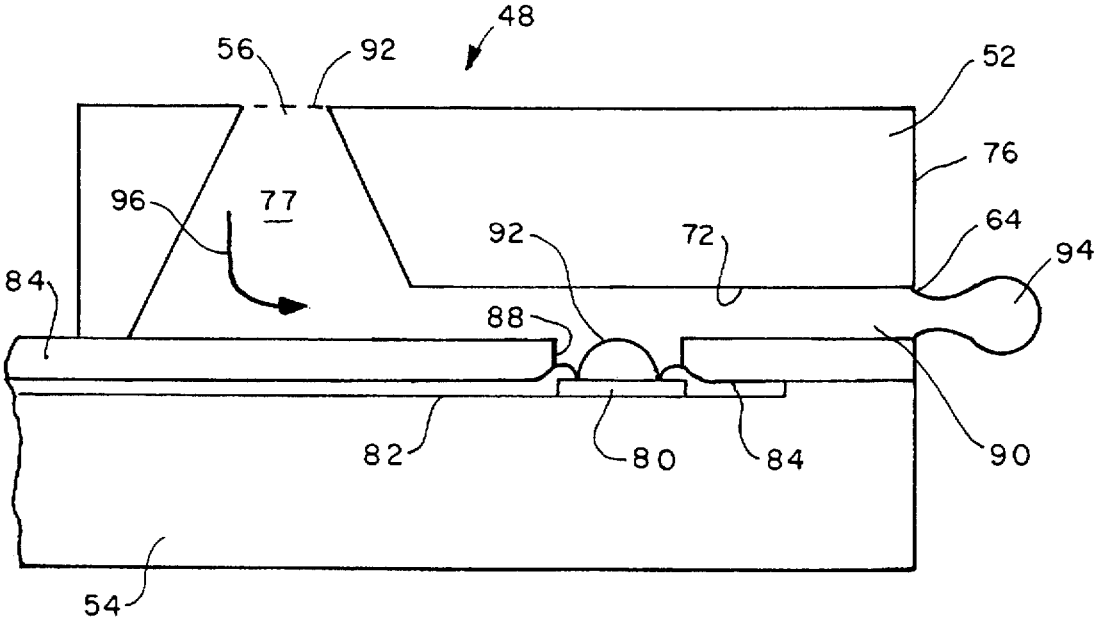
FIG. 5 is a cross-section of a thermal ink jet printhead generally of the configuration of FIGS. 3 and 4.

Referring now to FIGS. 3–5 the essential components of a thermal ink jet printer are described. Particularly, printer bar 40 is mounted horizontally and directly aligned with the rotational axis of a mandrel 42. Contacting the mandrel 42 is a sheet of paper 44 or any other recording medium. The direction in which the sheet 44 moves with respect to the print or bar is indicated by arrow 46.

In general, the printer bar 40 has a plurality of butted printheads 48 disposed on an upper surface 50. The printheads 48 are comprised of modules that include a heat sink substrate 54 and an ink manifold 52 to which ink is supplied via inlet 56. Typically, ink is supplied via a conduit (not shown) to inlets 56. Each printhead 48 includes ink jets numbered 60–65 laterally spaced apart by precise distances on a surface facing the sheet 44. The nozzles are coplaner with each other and generally stretch the full page width.

In general, the printhead 48 includes a capillary filled channel 72 terminating with a nozzle (64 in FIG. 5) at the edge or side 76 of the printhead. The other end of the channel communicates with reservoir 77 which is anistropically etched in ink manifold 52, typically constructed of silicon. The reservoir 77 is formed by through etching which provides inlet 56 for entrance of the ink 90 through filter 92 which is placed over the inlet 56. The ink and the channels are supplied by capillary action from reservoir 77 as shown by arrow 96.

Heater plate 54 contains a heating element 80 and passivated addressing electrodes 82 and a common return 84 (passivation layer not shown) over which thick film layer 86, generally of polyimide, is laminated and patterned to provide individual recesses over each heating element to form pits 88.

As is known in the art, electric pulses are applied to the heating element 80, momentarily vaporizing ink which forms bubble 92 which in turn expels droplet 94 from nozzle 64.

In accordance with the invention, ink jets are fired sequentially 60–65 on module 48, sequentially **65*a*–60*a* on module 48*a* and sequentially 60*a*–65*b* on module 48*b*. In this manner, ink jet 65 on module 48 and ink jet 60*a* on printhead 48*a*** fire closest in time, preventing a significant divergence in the location of pixel printing as a result of the movement of the printing medium. Of course, in a typical commercial embodiment, it is anticipated that each printhead will be comprised of perhaps several hundred ink jets which are generally linearly aligned, although several stacked rows are certainly possible and would benefit equally from the invention.

The present invention is therefore generally directed to firing of the banks of jets in neighboring printheads in opposite order while maintaining the printhead array bar normal to the direction of paper motion. Thus, if the jets of one printhead having a horizontal array of 384 jets are fired sequentially from jet 1 to jet 384, the jets within the two neighboring printheads are sequentially fired from 384 to 1. In this manner, the teeth that would appear as a saw-tooth pattern are merged, and no perceptible gap is observed. Moreover, a horizontal line is printed that does not appear to be jagged to the naked eye. Rather, the line smoothly wanders up and down the printhead page in a continuous manner which is not visually apparent. In fact, visually, the line appears to be straight without defects. This occurs because at normal printing speeds, for example, 5 inches per second, the amplitude of the variation is only about 20 microns, while spacial frequency is very low (for example about 1.3 inches). Even at printhead speeds of 10 inches per second, the amplitude to the variation is only about 20 to 80 microns with the same low spacial frequency in the defects and are not visible. Accordingly, a spreadsheet containing many horizontal and vertical lines, a very difficult task for a full page width printhead, does not depict a saw-tooth pattern when the present invention is incorporated into the printing device.

In fact, FIGS. 6A and 6B were prepared to represent the advantages of the present invention. Particularly, in each embodiment, thirteen 384 thermal ink jet printheads were aligned horizontally. FIG. 6A depicts jets being fired sequentially from 1 to 384 on each printhead while in FIG. 6B, jets are fired in alterative direction in adjacent printheads, i.e. from 1 to 384 and 384 to 1. In each instance the paper feed was long-edge and the saw tooth in FIG. 6A is particularly apparent to along the longest horizontal line of the spreadsheet. Alternatively, FIG. 6B does not demonstrate a saw tooth pattern.

Thus, it is apparent that there has been provided, in accordance with the invention, a printing system that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to brace all such alternatives, modifications, and variations as fall within the spirit and broad scope of the appended claims.

Having thus described the invention, it is now claimed:

1. A printing device having an ink jet printhead array for propelling ink to create a line on a recording medium, the printhead array comprising:

(a) a plurality of adjacent and generally linear printheads, said printheads including a plurality of generally linear arrayed ink jets, said linear array of ink jets on each printhead having a first and second end ink jet, said first end ink jet of a first printhead being adjacent a second end ink jet of a second adjacent printhead;

(b) a plurality of electrodes in communication with said ink jets; and (c) a microprocessor in control of said electrodes to selectively provide a current signal representing digitalized data to the electrodes;

wherein a digitalized signal intended to create a line on said recording medium more than one printhead wide results in initializing said ink jets on adjacent printheads forming said line from a first end ink jet to a second end ink jet on a first printhead and from a second end ink jet to a first end ink jet on said adjacent printhead.

2. The printing device of claim 1 wherein said ink jets are thermal electrically operated.

3. The printing device of claim 1 wherein said ink jets are piezoelectrically operated.

4. The printing device of claim 1 wherein said ink jet printhead array is a full page width.

5. The printing device of claim 1 wherein said ink jet printhead array is a partial page width.

6. The printing device of claim 1 wherein said recording medium is moved adjacent said printhead array during a printing procedure.

7. The printing device of claim 6 including a mandrel or a continuous belt to transport said moving recording medium.

8. The printer device of claim 6 wherein said recording medium moves at a printing speed of about 5 inches per second.

9. The printing device of claim 1 including at least ten printheads.

10. The printing device of claim 9 including at least two hundred ink jets per printhead.

11. A method of printing comprising the steps of:

providing a recording medium adjacent to an elongated printing member having at least two generally linearly aligned printheads, said printheads being comprised of a plurality of generally linearly aligned ink jets, and selectively providing a firing signal to said aligned ink jets to print on said recording medium, wherein adjacent printheads fire said ink jets in directionally opposed sequences, such that adjacent ink jets on adjacent printheads fire substantially closest in time to one another.

12. The method of claim 11 wherein said recording medium is moving during said firing of said ink jets.

13. The method of claim 11 wherein said ink jets are thermal electrically operated.

14. The method of claim 11 wherein said ink jet printhead array is a full page width.

15. The method of claim 12 wherein said recording medium moves at a printing speed of about 5 inches per second.

* * * * *